United States Patent [19]

Kiel

[11] 4,125,269

[45] Nov. 14, 1978

[54] RECLINER-ROCKER GERIATRIC WHEEL CHAIR

[76] Inventor: Louise A. Kiel, 700 E. 5th, Apt. 114, Des Moines, Iowa 50316

[21] Appl. No.: 779,469

[22] Filed: Mar. 21, 1977

[51] Int. Cl.[2] ..... A47C 1/034

[52] U.S. Cl. ..... 280/30; 188/2 F; 280/47.4; 297/DIG. 4

[58] Field of Search ..... 280/30, 47.4; 297/DIG. 4; 188/2 F, 22, 74

[56] References Cited

U.S. PATENT DOCUMENTS

| | | | |
|---|---|---|---|
| 1,591,529 | 7/1926 | Guerber | 188/2 F |
| 3,216,738 | 11/1965 | Bockus | 297/DIG. 4 |
| 3,415,531 | 12/1968 | Kiel | 280/30 |
| 3,761,126 | 9/1973 | Mulholland | 297/DIG. 4 X |
| 3,881,773 | 5/1975 | Rodaway | 297/DIG. 4 X |

*Primary Examiner*—Joseph F. Peters, Jr.
*Assistant Examiner*—Michael Mar
*Attorney, Agent, or Firm*—Henderson, Strom, Sturm, Cepican & Fix

[57] ABSTRACT

A recliner-rocker geriatric wheel chair having a unitary member movable between a first position wherein the chair is allowed to rock and a second position wherein the chair is prevented from rocking motion. In the first position the unitary member functions to both stabilize the chair against rearward tilt and to brake the ground engaging wheel against movement. In the second position the unitary member engages the seat portion of the chair and prevents it from rocking.

11 Claims, 8 Drawing Figures

RECLINER-ROCKER GERIATRIC WHEEL CHAIR

BACKGROUND OF THE INVENTION

The present invention relates generally to geriatric wheel chairs and more particularly to a chair both suitable for rocking in a stationary position and suitable for transporting the geriatic patient from one place to another. The concept of a rocking wheel chair stabled against tilt and movement is disclosed in the invention of U.S. Pat. No. 3,415,531. That invention however utilized a complex structure and linkage to simultaneously effect the ground engagement stabilizer member and the braking of the wheels. Complex structure was necessary because the occupant of the chair effected the change from the rocking to non-rocking position, and the reverse, by means of a lever positioned to one side of the chair.

Those concerned with the safety and comfort of the invalids, particularly in the field of geriatrics, recongize the need for a simpler structure. Since geriatric patients are frequently accompanied by an attendent when moving from place to place, the complex structure associated with an occupant operated device can be eliminated.

SUMMARY OF THE INVENTION

The recliner-rocker geriatric wheel chair of the instant invention comprises a mobile frame, a chair member rockably mounted on the mobile frame, and means to convert the chair from one suitable for rocking to one suitable for transporting. The unitary member attached to the rear of the frame, and operable by an attendent, functions as a tilt stabilizer and brake in the first position where the chair is adapted for rocking, and functions as a stop to prevent the rocking of the chair when the chair is adapted for transport.

An object of the present invention is a provision of an improved rocking wheel chair.

Another object is to provide a rocking wheel chair stable against tilt or movement while in a rocking position and stable against rocking while in a transport position.

A further object of the invention is the provision of a rocking wheel chair having a simple operating structure.

Still another object is to provide a rocking wheel chair being economical to manufacture and easy to maintain.

A still further object of the present invention is the provision of a rocking wheel chair which is both comfortable and safe for the geriatric patient.

Other objects, advantages, and novel features of the present invention will become apparent from the following detailed description of the invention, when considered in conjunction with the accompanying drawings.

DESCRIPTION OF THE PREFERRED EMBODIMENT

Figure 1:
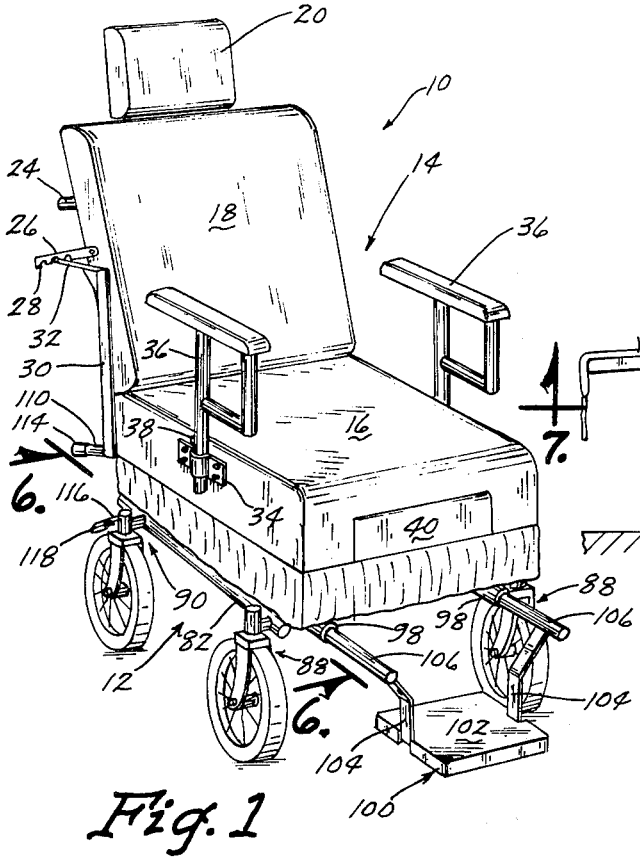
FIG. 1 is a perspective view of the recliner rocker geriatric wheel chair of the present invention.

Referring now to the drawings, wherein like reference numerals designate identical or corresponding parts throughout the several views, FIG. 1 shows the recliner-rocker wheel chair designated generally by reference numeral 10. The wheel chair 10 includes a mobile frame 12 having a chair 14 rockably mounted thereon.

Figure 2:
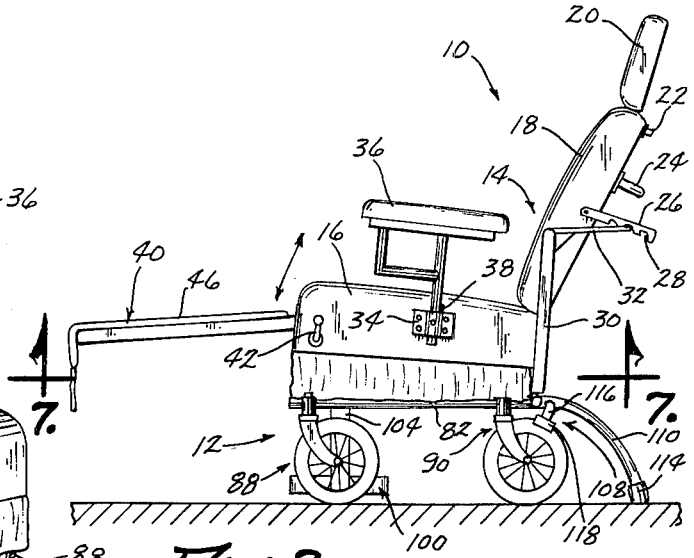
FIG. 2 is a side elevational view showing the recliner rocker in a rocking position, with the tilt stabilizer in a ground engaging position and the brake in a wheel engaging position.
Figure 3:
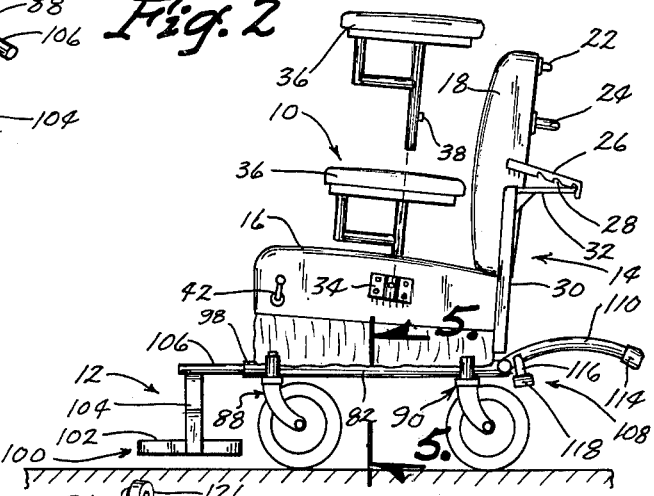
FIG. 3 is a side elevational view of the chair showing the chair in the transport position.

The chair 14 comprises a seat portion 16 and a back portion 18 hingedly attached to the rear thereof. A detachable headrest 20 is mounted on the central upper edge of back portion 18 and it is secured thereto by clamp 22. The wheel chair 10 can be used with or without the headrest 20 as illustrated by FIGS. 2 and 3. The seat 16, back 18, and headrest 20 are suitable upholstered to allow for the comfort of the occupant.

An attendent hand rail 24 is attached to the rearward side of the back 18 and is used by the attendent to move the wheel chair 10 from place to place. A pair of adjustment straps 26 are pivotally attached to opposite vertical sides of the back 18 and have a plurality of downwardly directed notches 28 formed therein. A pair of straps 30 are rigidly attached to opposite lateral edges of the seat 16 near the rear thereof and extend upwardly. An adjustment bar 32 connects the upper ends of straps 30 and extends horizontally rearward and transverse to the back 18. The notches 28 are adapted to engage the transverse portion of bar 32 and, thus, hold the back 18 in a series of reclining positions as shown in FIGS. 1–3.

A pair of brackets 34 are rigidly attached to opposite lateral edges of the seat 16 and are positioned approximately midway between the front and rear. The brackets 34 form a vertical opening into which the detechable armrest 36 is received. The armrests 36 are restrained against rotation and downward movement by any suitable means, such as ear 38 which engages a notch in the bracket 34. As shown in FIG. 3, the armrest 36 is simply raised vertically out of the bracket 34 when it is desired to remove the occupant laterally out of the wheel chair 10.

Figure 7:
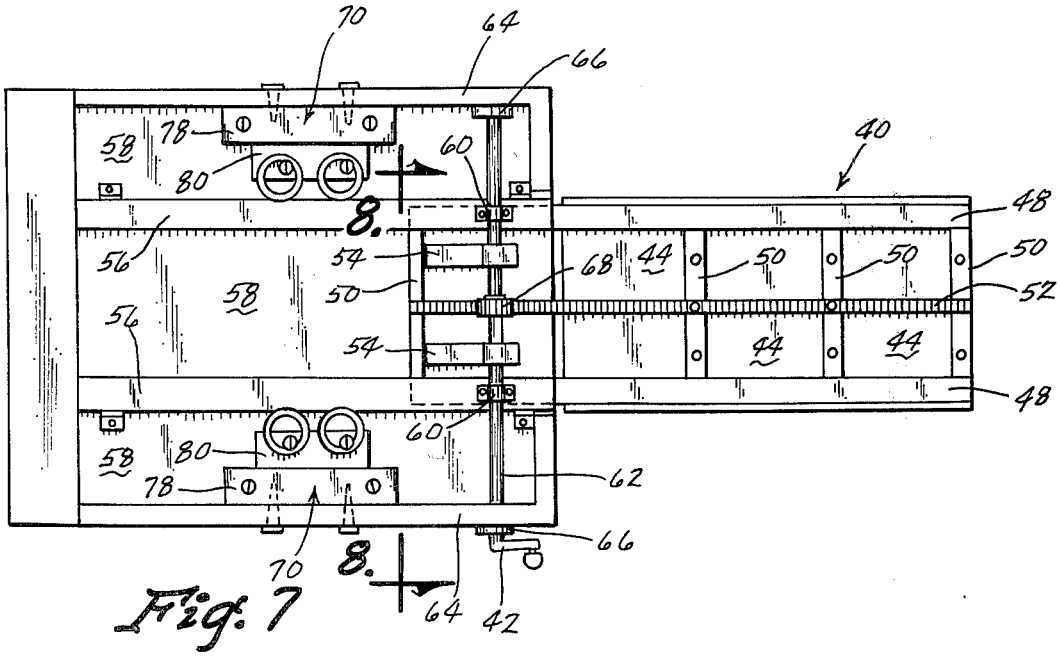
FIG. 7 is a bottom plan view taken along line 7—7 of FIG. 2 showing the leg rest in an extended position.

The seat portion 16 further includes a leg rest 40 which is movable between a concealed position within the seat portion 16, as shown in FIGS. 1 and 3, and an extended position, as shown in FIGS. 2 and 7. The extension and retraction of the leg rest 40 is accomplished by rotating the operator handle 42 located at one side of the seat portion 16; thus, the occupant can easily adjust the position of leg rest 40.

Figure 8:
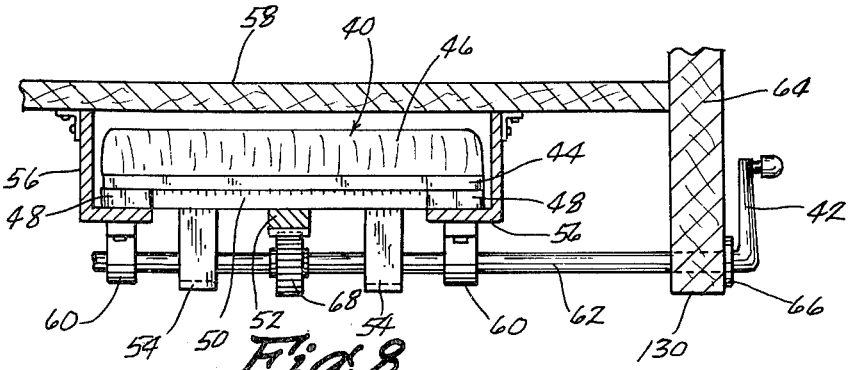
FIG. 8 is an enlarged sectional view taken along line 8—8 of FIG. 7.

As most clearly shown in FIGS. 7 and 8, the leg rest 40 includes a leg board 44 covered with upholstering 46. A pair of metal straps 48 are secured to the underside of board 44 at its lateral edge. A series of transverse straps 50 extend between straps 48 and a rack gear 52 is secured by weldment or the like to straps 50. The rack gear 52 is disposed central to the board 44 and extends along the entire length thereof, as shown in FIG. 7. A pair of stop bars 54 are attached to the rearwardmost strap 50 and serve to prevent the overextension of leg rest 40.

Looking now to FIG. 8, a pair of guides 56 are secured to the underside of seat board 58. The guides 56 are adapted to slidably receive the leg rest 40. A pair of bearings 60 are attached to the forward portion of the guides 56 and rotatably secure shaft 62. Shaft 62 extends transverse to the leg rest 40 and is journaled in opposite side boards 64 by bearings 66. One end of shaft 62 extends through side board 64 and is attached to operator handle 42. A circular gear 68 is fitted on shaft 62 and is disposed such that the teeth thereof engage the teeth of rack gear 52.

By rotating operator handle 42, the occupant of the chair can extend or retract the leg rest 40. When the leg rest 40 is in the fully extended position, stop bars 54 engage shaft 62 to prevent its further extension.

Figure 6:
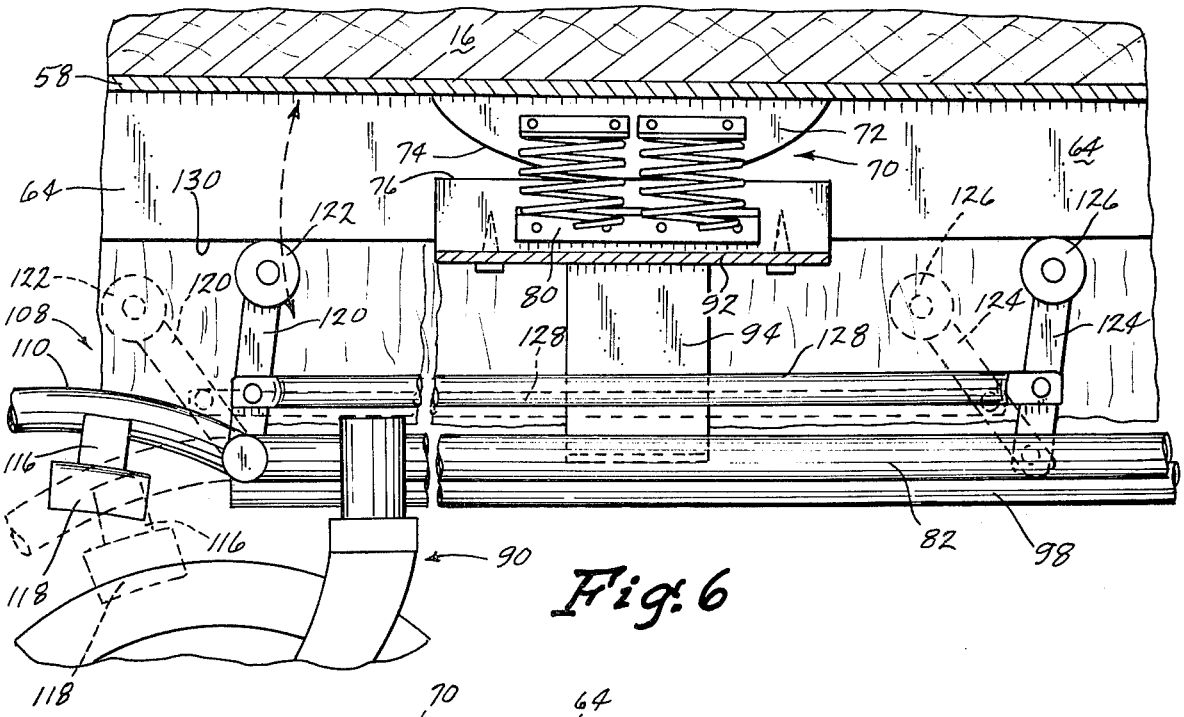
FIG. 6 is a sectional view taken along line 6—6 of FIG. 1 showing the transport position in solid lines, and the rocking position in dotted lines.

The seat portion 16 also includes a conventional platform rocking mechanism 70, as most clearly shown in FIGS. 6 and 7. Rocking mechanism 70 includes a rocker member 72 rigidly secured to side board 64. The lower curved edge 74 of rocker 72 is disposed to rock on the top edge 76 of plate 78. Rocker member 72 and plate 78 are attached by spring assembly 80. It is understood that the forward curved edge 74 could be squared off to limit rocking movement in the forward direction.

Figure 4:
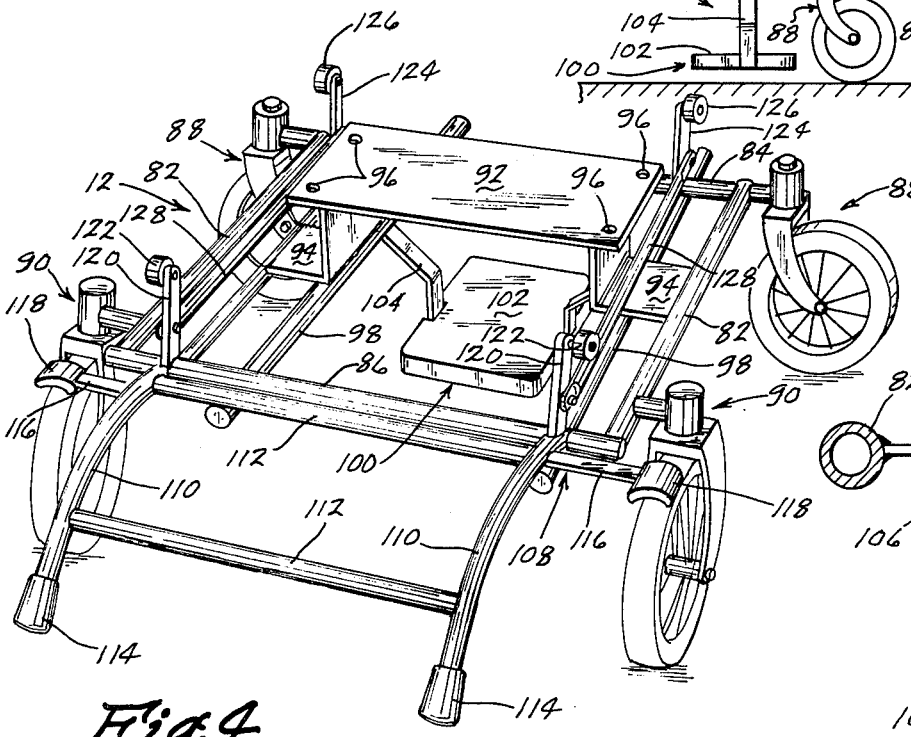
FIG. 4 is a perspective view of the mobile frame of the chair.

As most clearly shown in FIG. 4, the frame 12 includes lateral bars 82 connected at the front and rear, by transverse bar 84 and 86, respectively. Caster wheels 88 are secured to the forward ends of lateral bars 82 and laterally aligned wheels 90 are secured near the rear of lateral bars 82. Platform 92 is attached between bars 82 by flanges 94 and has holes 96 therein to allow attachment to plate 78 of the chair 14.

Figure 5:
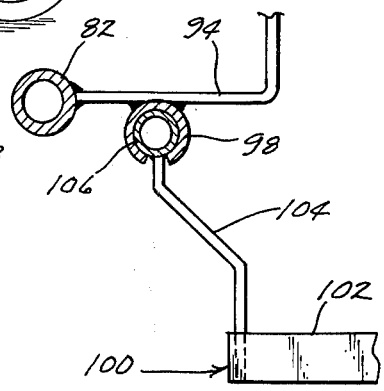
FIG. 5 is an enlarged sectional view taken along line 5—5 of FIG. 3.

A pair of lateral tubular members 98 are attached to the underside of flange 94, as shown in FIG. 5. Tubular members 98 are adapted to slidably receive foot rest 100. Foot rest 100 includes a foot plate 102 supported by upwardly extending straps 104. Straps 104 are attached to lateral bars 106 which are telescopically received in tubular members 98. The foot rest 100 can thus be positioned in a concealed position under frame 12, as shown in FIG. 2, or in an extended position, as shown in FIG. 3.

An integrally formed member 108 is pivotally attached to the rear transverse bar 86, as most clearly shown in FIGS. 4 and 6. Unitary member 108 includes a pair of arcuate stabilizer bars 110 which extend rearward of frame 12 and are connected by cross members 112. The free ends of the stabilizer bars 110 are fitted with antiskip caps 114. A pair of braking means, including a rod 116 and an arcuate plate 118, are rigidly attached to bars 110 and extend outwardly therefrom as illustrated in FIG. 4. A pair of upwardly extending rear stop rods 120 are rigidly attached at the forward end of bars 110 and rollers 122 are rotatably mounted on the free ends of rods 120. The unitary member 108 is movable between a first position and a second position which will be described in detail hereinafter.

A pair of front stop rods 124 are pivotally attached at one end to the frame 12 and rollers 126 are rotatably mounted on the free ends thereof. A pair of connecting rods 130 are pivotally attached at one end to rear stop rods 120 and pivotally attached at the opposite end to front stop rods 124. Movement of the rear stop rod 120 is, therefore, transmitted to the front stop rod 124, such that they will both be in a lowered position or a seat engaging position simultaneously, as shown in FIG. 6.

When the unitary member 108 is in the first position, as shown in FIGS. 2, 4 and the dotted lines of FIG. 6, the stabilizer bar 110 is in a ground engaging position, the arcuate braking plate 118 is engaging the peripheral surface of the wheel 90, and the rear stop rod 120 is in a lowered position. Thus, in the first position the wheel chair 10 is stabilized against rearward tilt and movement while the chair portion 14 is allowed to rock.

When the unitary member 108 is in the second position, as shown in FIGS. 3 and 6, the stabilizer bar 110 is in the raised position, the arcuate braking plate 118 is in the raised position, and rollers 122 of rear stop rod 120 engage the lower surface 130 of side board 64 forward of the pivot point of unitary member 108; in a locked, over-center position. Thus, in the second position the wheel chair 10 is stabilized against rocking motion and made safe for transport from one area to another.

Movement of the unitary member 108 between the first and second position is easily accomplished by an attandant positioned at the rear of the wheel chair 10. The lower cross member 112 serves as convenient bar which can be operated by the attendent's foot.

Obviously, many modifications and variations of the present invention are possible in light of the above teachings. It is therefore to be understood that, within the scope of the appended claims, the invention may be practiced otherwise than as specifically described.

I claim:

1. A geriatric wheel chair, comprising:

a frame;

ground engaging wheels mounted to said frame;

a chair member having a seat portion and a back portion mounted to said frame;

means for rockably mounting said chair member to said frame; and a unitary member pivotally attached to the rear of said frame said unitary member consisting of:

a stabilizer bar movable between a ground engaging position and a raised position;

a braking means movable between a wheel engaging position and a raised position, whereby the braking means is in the wheel engaging position when the stabilizer bar is in the ground engaging position, and the braking means is in the raised position when the stabilizer bar is in the raised position; and rear stop means movable between a lowered position and a seat engaging position, whereby the rear stop means is in the lowered position enabling the seat to rock when the stabilizer bar is in the ground engaging position, and the rear stop means is in the seat engaging position when the stabilizer bar is in the raised position.

2. The geriatric wheel chair of claim 1, further comprising:

forward stop means pivotally attached to the forward portion of said frame, said forward stop being movable between a lowered position and a seat engaging position; and means for connecting said forward stop to said unitary member, whereby movement of said unitary member results in a simultaneous movement of said forward stop.

3. The geriatric wheel chair of claim 1, further including:

roller means mounted on the free end of said rear stop means, whereby movement of the rear stop means between the lowered position and the seat engaging position is facilitated.

4. The geriatric wheel chair of claim 2, further including:

roller means mounted on the free end of said forward stop means.

5. The geriatric wheel chair of claim 1, further comprising:

a leg rest carried by said seat portion and movable between a concealed position within the seat portion and an extended position; and means for moving said leg rest operable from the seat portion of said chair.

6. The geriatric wheel chair of claim 5, wherein said moving means includes:

a rack gear mounted on said leg rest;

a rotatable shaft extending transverse to said seat portion and rotatably mounted to said seat portion;

a gear mounted on said shaft and operably engaged with said rack gear; and operator means attached at one end of said shaft and extending outwardly of said seat portion, whereby the occupant of said chair can rotate the operator means to move the leg rest between the concealed and the extended position.

7. The geriatric wheel chair of claim 1, further comprising:

means for adjusting said back portion with respect to said seat portion in a plurality of positions, whereby the back portion is movable from an upright position to a variety of reclining positions.

8. The geriatric wheel chair of claim 1, further comprising:

a foot rest slidably carried by said frame and movable between a concealed position under said frame and an extended position.

9. The geriatric wheel chair of claim 1, further comprising:

detachable arm rests mounted on said seat portion.

10. A geriatric wheel chair, comprising:

a frame;

ground engaging wheels mounted to said frame;

a chair member, having a seat portion and a back portion, mounted to said frame;

means for rockably mounting said chair member to said frame;

a member pivotally attached to the rear of said frame and movable between a first position and a second position;

a stabilizer bar rigidly attached to said member, said stabilizer bar being in a ground engaging position when said member is in said first position, and being in a raised position when said member is in said second position;

a braking means rigidly attached to said member, said braking means being in a wheel engaging position when said member is in said first position, and being in a raised position when said member is in said second position; and rear stop means rigidly attached to said member, said rear stop means being in a lowered position when said member is in said first position, and being in a seat engaging position when said member is in said second position.

11. A geriatric wheel chair, comprising:

a frame;

ground engaging wheels mounted to said frame;

a chair member having a seat portion and a back portion mounted to said frame;

means for rockably mounting said chair member to said frame;

a unitary member pivotally attached to the rear of said frame, said unitary member including:

a stabilizer bar movable between a ground engaging position and a raised position; and a braking means movable between a wheel engaging position and a raised position, whereby the braking means is in the wheel engaging position when the stabilizer bar is in the ground engaging position, and the braking means is in the raised position when the stabilizer bar is in the raised position;

a leg rest carried by said seat portion and movable between a concealed position within the seat portion and an extended position;

means for moving said leg rest operable from the seat portion of said chair, wherein said moving means includes:

a rack gear mounted on said leg rest;

a rotatable shaft extending transverse to said seat portion and rotatable mounted to said seat portion;

a gear mounted on said shaft and operably engaged with said rack gear; and operator means attached at one end of said shaft and extending outwardly of said seat portion, whereby the occupant of said chair can rotate the operator means to move the leg rest between the concealed and the extended position.

* * * * *